US006009904A

United States Patent [19]

Yang

[11] Patent Number: 6,009,904

[45] Date of Patent: Jan. 4, 2000

[54] DIVERTER TUB SPOUT BODY

[76] Inventor: Johnny Yang, No. 139-1, Lane 498, Sec. 3, Lu Ho Rd., Lu Kang Chen, Chang Hua Hsien, Taiwan

[21] Appl. No.: 09/234,477

[22] Filed: Jan. 21, 1999

[51] Int. Cl.[7] ..... E03C 1/04

[52] U.S. Cl. ..... 137/801; 4/678; 137/119.05

[58] Field of Search ..... 4/678; 137/119.05, 137/801

[56] References Cited

U.S. PATENT DOCUMENTS 3,739,806 6/1973 Bucknell et al. ..... 4/678 X

*Primary Examiner*—Gerald A. Michalsky
*Attorney, Agent, or Firm*—Rosenberg, Klein & Lee

[57] ABSTRACT

A diverter tub spout body includes a longitudinal portion and a transverse portion extending from the longitudinal portion with a separate wall connected between the longitudinal portion and the transverse portion. A connecting tube extends from the separate wall, the interior of the transverse portion and the interior of the longitudinal portion communicates with each other via the connecting tube and a hole defined through the separate wall. An aperture is defined through the separate wall and located between the peripheral wall of the longitudinal portion so as to dispense bubbles when the diverter tub spout body is immersed into the electroplating bath solution.

3 Claims, 8 Drawing Sheets

DIVERTER TUB SPOUT BODY

FIELD OF THE INVENTION

The present invention relates to a spout body for a tub spout, and more particularly, to a diverter tub spout having an aperture defined through the separate wall connected between the transverse portion and the longitudinal portion so as to dispense air or bubbles when immersing the spout body into the plating bath solution.

BACKGROUND OF THE INVENTION

A conventional diverter tub spout body 10 is shown in FIG. 1 and comprises a longitudinal portion 22 and a transverse portion 100 which is connected to the top end thereof. A separate wall 23 is connected between the transverse portion 100 and the longitudinal portion 22 and has an connecting tube 24 extending from the separate wall 23, wherein the connecting tube 24 communicates with the interior 31 of the transverse portion 100 so as to be connected to a pipe (not shown). In order to prevent the copper or zinc made diverter tub spout body 10 from getting rust, an electroplating process is necessary which immerses the diverter tub spout body 10 into the electroplating bath solution 11 with the longitudinal portion 22 first to let entire diverter tub spout body 10 immersed below the level of the electroplating bath solution 11. However, referring to FIG. 2, there will be bubbles 12 collected in the recessed portions defined between the connecting tube 24, the separate wall 23 and the spout body of the longitudinal portion 22 so that the electroplating bath solution 11 cannot attach onto the interior of the two recessed portions so that rust will be found in the recessed portions.

The present invention intends to provide a diverter tub spout body which has an aperture defined through the separate wall located in either one of the recessed portions so as to dispense bubbles therefrom. The aperture improves the result of the electroplating process so that the shortcomings happened on the conventional diverter tub spout body can be well handled.

SUMMARY OF THE INVENTION

In accordance with one aspect of the present invention, there is provided a diverter tub spout body comprising a longitudinal portion and a transverse portion with a separate wall connected therebetween through which a hole is defined which communicates with a connecting tube extending downwardly from the separate wall. An aperture is defined through the separate wall and located between the peripheral wall of the longitudinal portion such that bubbles are dispensed therefrom when the diverter tub spout body is immersed into the plating bath solution.

It is an object of the present invention to provide a diverter tub spout body having at least one aperture defined through the separate wall located between the longitudinal portion and the transverse portion so as to prevent bubbles being collected between the separate wall, the connecting tube and the peripheral wall of the longitudinal portion.

Further objects, advantages, and features of the present invention will become apparent from the following detailed description with appropriate reference to the accompanying drawings.

DETAILED DESCRIPTION OF THE PREFERRED EMBODIMENTS

Figure 1:
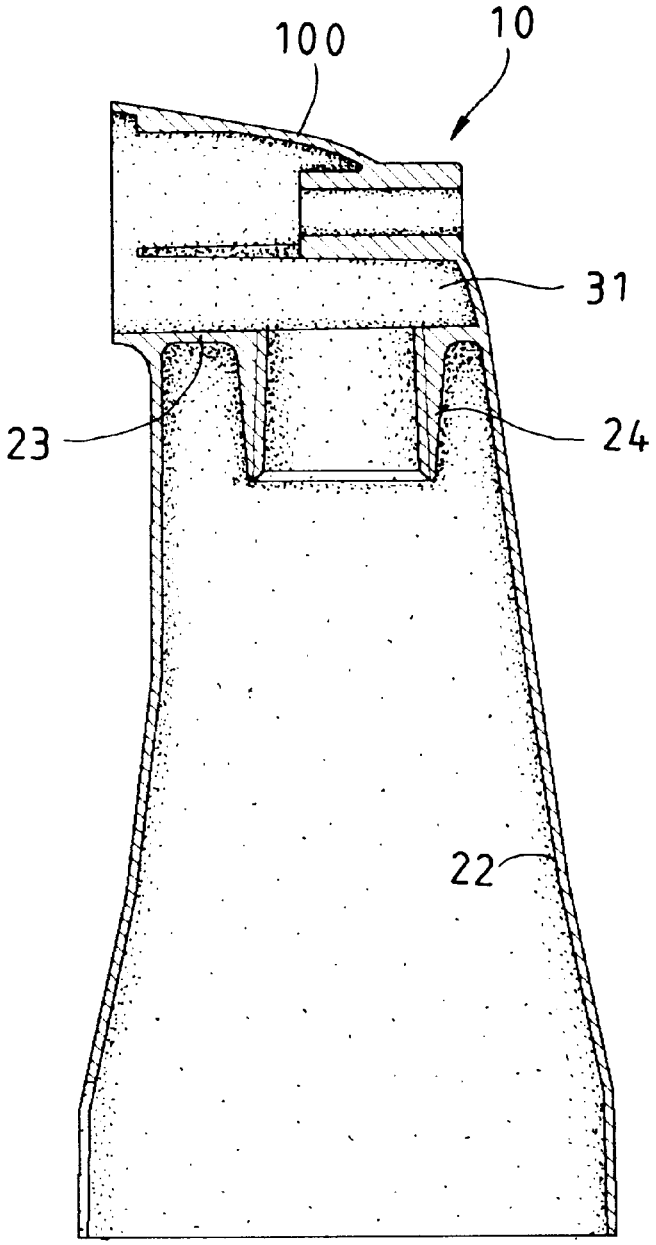
FIG.1 PRIOR ART
FIG. 1 is a side elevational view, partly in section, of a conventional diverter tub spout body.
Figure 2:
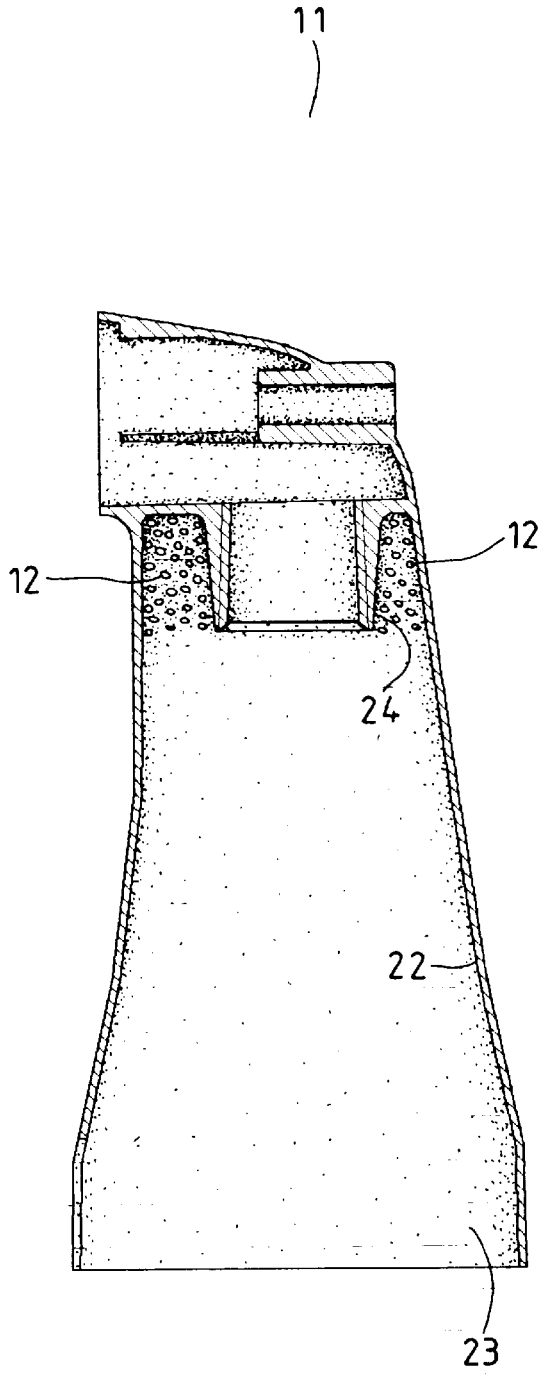
FIG.2 PRIOR ART
FIG. 2 is an illustrative view to show the bubbles are collected in the recessed portions when the conventional diverter tub spout body is immersed into the electroplating bath solution.
Figure 3:
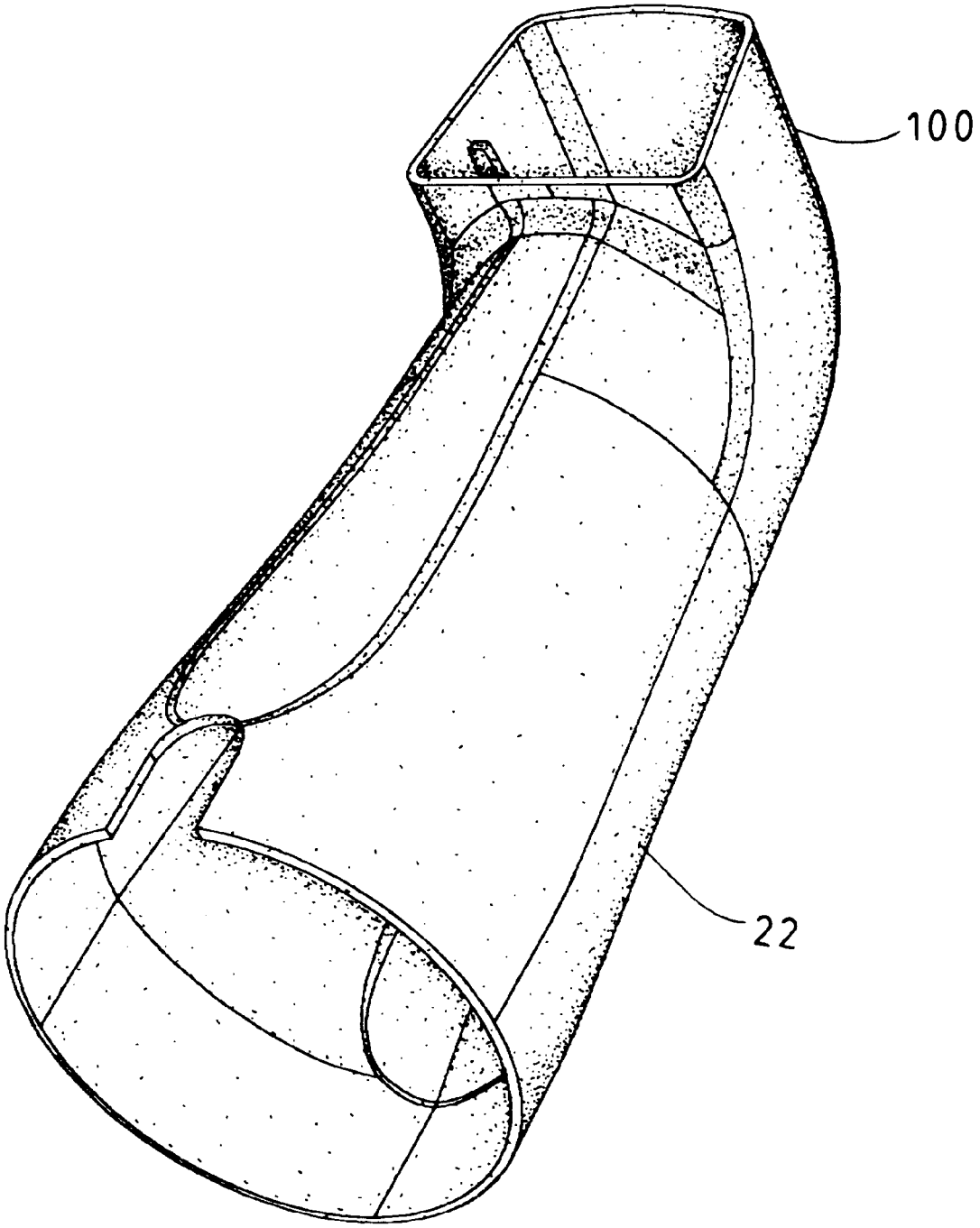
FIG. 3 is a perspective view of the diverter tub spout body in accordance with the present invention.
Figure 4:
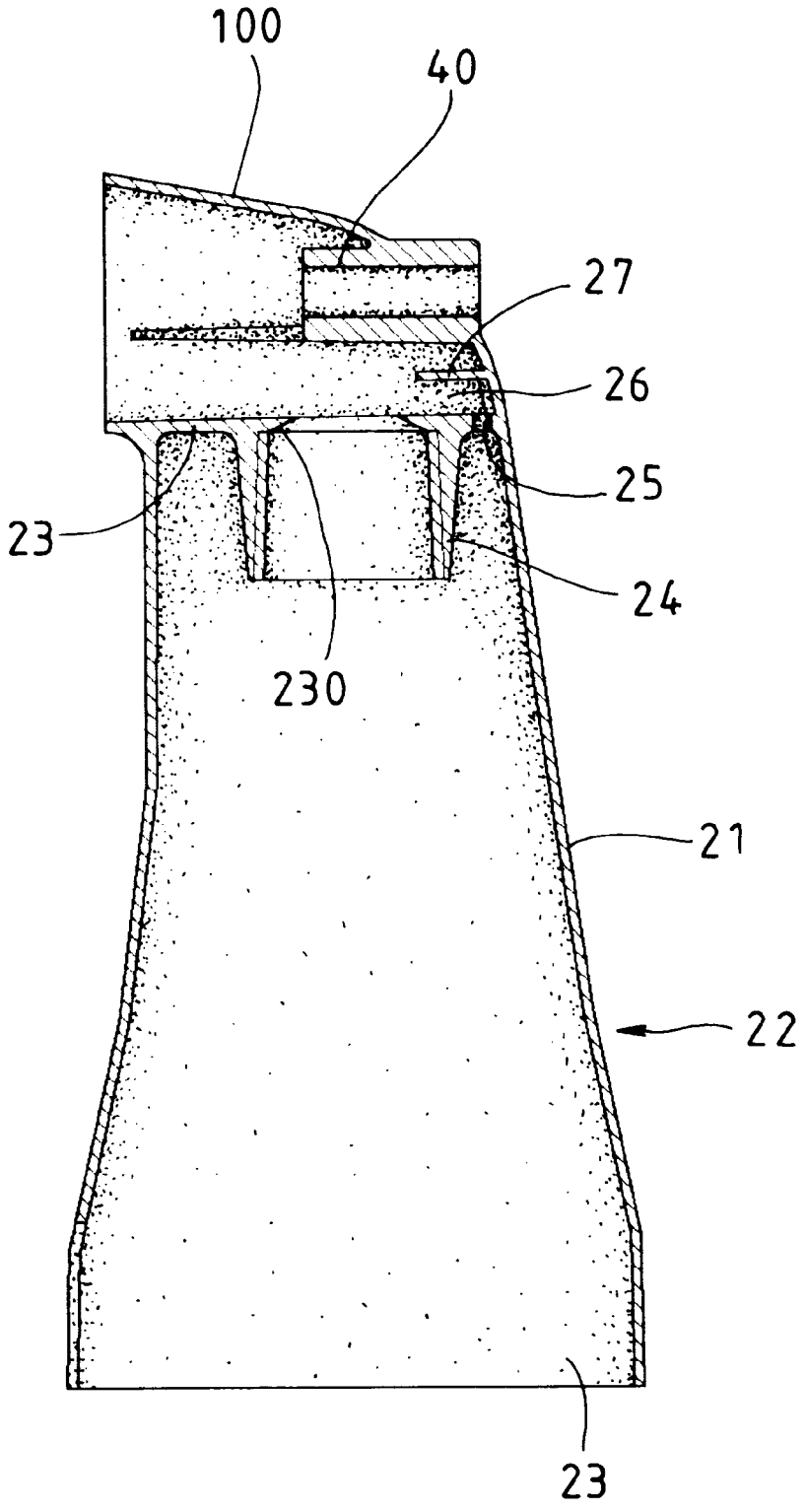
FIG. 4 is a side elevational view, partly in section, of the diverter tub spout body in accordance with the present invention.
Figure 5:
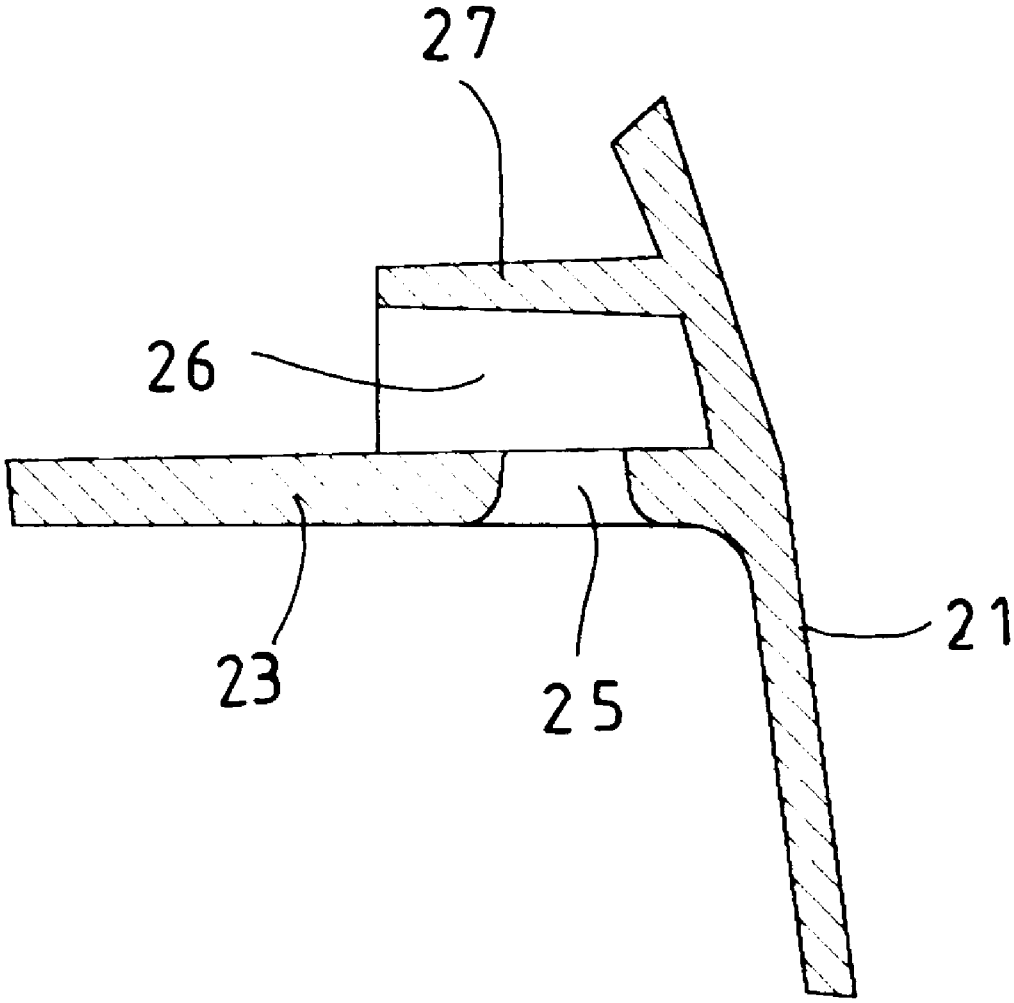
FIG. 5 is an enlarged view to show the aperture and the plate located above the aperture of the apertures in the diverter tub spout body of the present invention.
Figure 9:
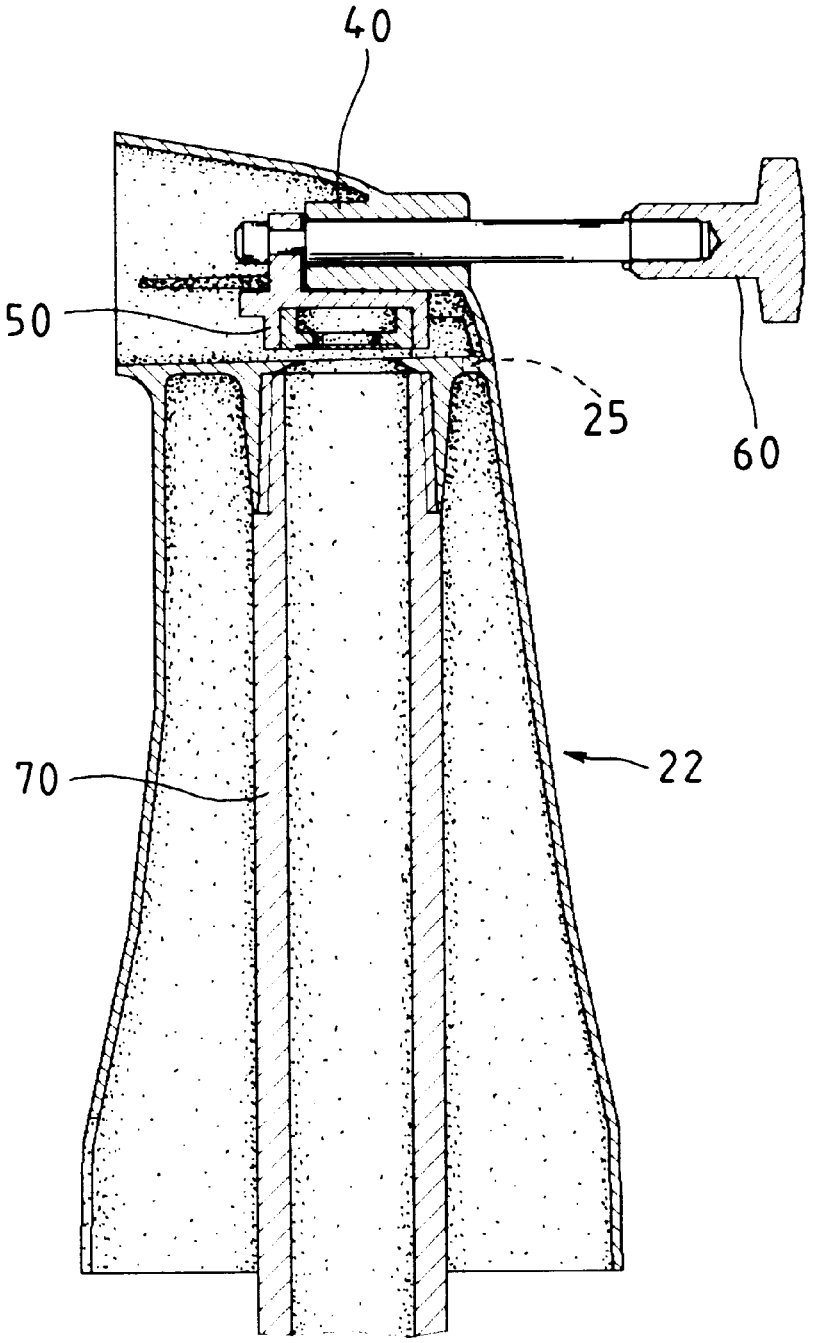
FIG. 9 is a side elevational view, partly in section, of the diverter tub spout body with a control lift rod and a diverter gate therein.

Referring to FIGS. 3 to 5, A diverter tub spout body 20 in accordance with the present invention comprises a longitudinal portion 22 and a transverse portion 100 which has a tubular member 40 disposed therein so as to receive a control lift rod 60 therein as shown in FIG. 9. A separate wall 23 is connected between the longitudinal portion 22 and the transverse portion 22 with a hole 230 defined through the separate wall 23. A connecting tube 24 extends from the separate wall 23 and extends into the longitudinal portion 22 so as to be connected with a pipe 70 as shown in FIG. 9. The connecting tube 24 communicates with the hole 230 so that the interior of the transverse portion 100 the interior of the longitudinal portion 22 are communicated with each other. An aperture 25 is defined through the separate wall 23 and located between the peripheral wall 21 of the longitudinal portion 22 such that the interior 31 of the transverse portion 100 communicates with the interior of the longitudinal portion 22 via the aperture 25. A plate 27 extending from the inside of the transverse portion 100 and is located above the aperture 25 so as to define a zone 26 between the plate 27 and the separate wall 23, wherein the inner diameter of the periphery defining the zone is larger than the diameter of the aperture 25. The plate 27 is designed to prevent water flowing back into the longitudinal portion 22 via the aperture 25 when the diverter gate 50 (see FIG. 9) is operated by the control lift rod 60.

Figure 8:
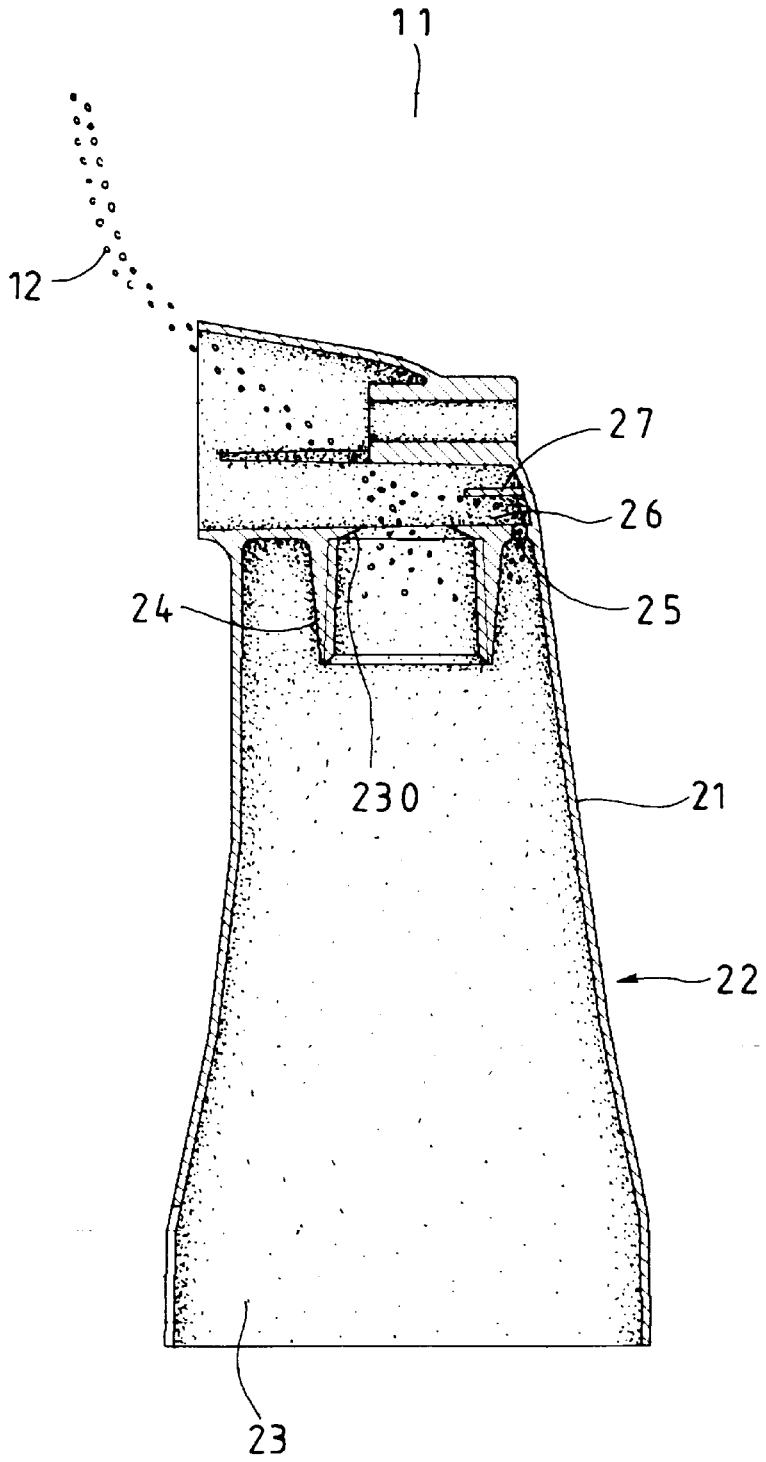
FIG. 8 is an illustrative view to show the bubbles are dispensed via the aperture defined in the separate wall in the diverter tub spout body of the present invention.

Referring to FIG. 8, when the diverter tub spout body 20 is completely immersed into the electroplating bath solution I1, bubbles 12 will be dispensed via the hole 230 and the aperture 25 so that the electroplating bath solution 11 can reach any portion of the diverter tub spout body 20. That is to say, the diverter tub spout body 20 will be evenly and completely electroplated.

Figure 6:
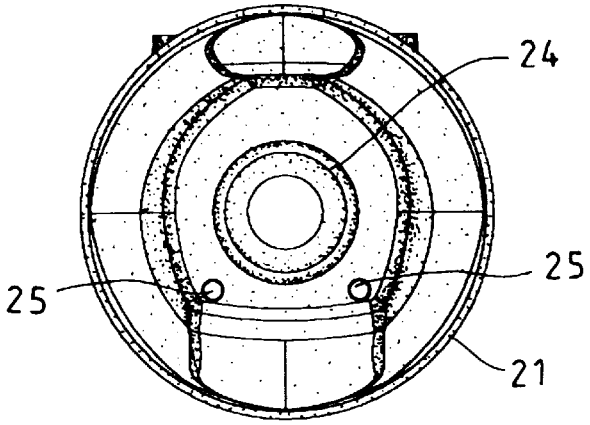
FIG. 6 is a top view to show the locations of the apertures in the diverter tub spout body of the present invention.
Figure 7:
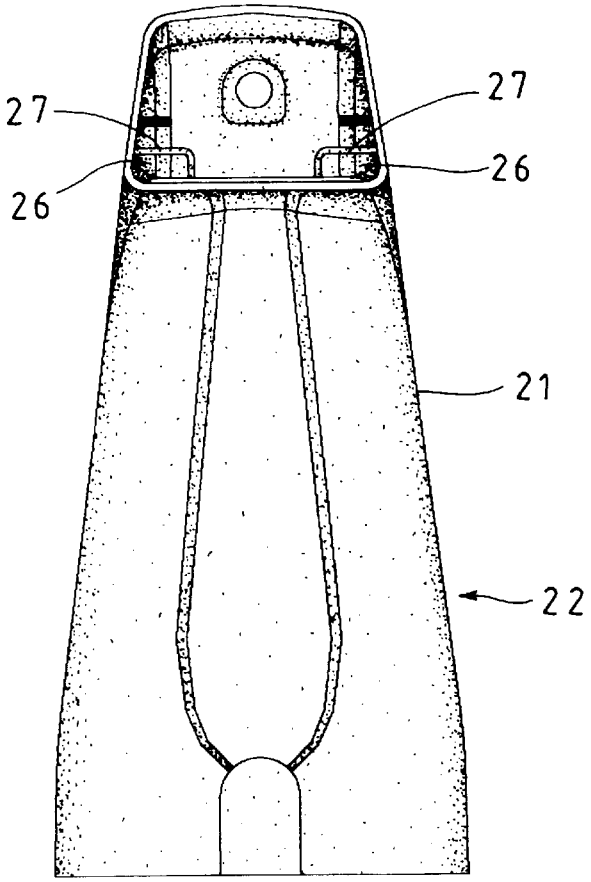
FIG. 7 is a front side elevational view of the apertures in the diverter tub spout body of the present invention.

Of course, referring to FIGS. 6 and 7, the separate wall 23 may have two or more than two apertures 25 defined therethrough so as to quickly release these bubbles 12.

By the apertures 25 defined through the separate wall 23, the result of the electroplating process will be improved. To define the apertures 25 is easily achieved and does not need to change the molds when manufacturing the diverter tub spout body 20.

The invention is not limited to the above embodiment but various modification thereof may be made. It will be understood by those skilled in the art that various changes in form and detail may made without departing from the scope and spirit of the present invention.

What is claimed is:

1. A diverter tub spout body comprising:

a longitudinal portion and a transverse portion with a separate wall connected between said longitudinal portion and said transverse portion, a hole defined through said separate wall and a connecting tube extending from said separate wall and communicating with said hole and the interior of said transverse portion, an aperture defined through said separate wall and located adjacent a peripheral wall of said longitudinal portion such that the interior of said transverse portion communicates with the interior of said longitudinal portion.

2. The diverter tub spout body as claimed in claim 1 further comprising a tubular member connected in said transverse portion so as to be adapted to receive a control lift rod member therein.

3. The diverter tub spout body as claimed in claim 2 further comprising a plate extending from the inside of said transverse portion and located above said aperture.

* * * * *